US005797635A

United States Patent [19]

Willems

[11] Patent Number: 5,797,635

[45] Date of Patent: Aug. 25, 1998

[54] LATCH

[75] Inventor: Roger Peter Willems, Penn, England

[73] Assignee: Penn Fabrication (U.S.A.) Inc., Moorpark, Calif.

[21] Appl. No.: 795,075

[22] Filed: Feb. 5, 1997

[51] Int. Cl.[6] ..... E05C 5/02

[52] U.S. Cl. ..... 292/111; 292/112; 292/113

[58] Field of Search ..... 292/111, 129, 292/98, 281, DIG. 49, 112, 113, DIG. 31, 337

[56] References Cited

U.S. PATENT DOCUMENTS

| | | | |
|---|---|---|---|
| 2,300,509 | 11/1942 | Komenak . | |
| 2,478,433 | 8/1949 | Swanson . | |
| 2,820,992 | 1/1958 | Schluter . | |
| 2,853,752 | 9/1958 | Schlueter | 292/113 |
| 3,030,137 | 4/1962 | Cheney . | |
| 3,277,677 | 10/1966 | Hurvitz . | |
| 3,965,705 | 6/1976 | Nadler . | |
| 4,090,727 | 5/1978 | Busch et al. | 292/111 |
| 4,244,611 | 1/1981 | Wahoski . | |
| 4,343,162 | 8/1982 | Giacometti . | |
| 4,522,436 | 6/1985 | Hoen et al. . | |
| 4,551,998 | 11/1985 | Ricouard et al. . | |
| 4,560,190 | 12/1985 | Werner | 292/111 |
| 4,588,216 | 5/1986 | Hinds . | |
| 4,679,833 | 7/1987 | Dueringer | 292/113 |
| 4,746,151 | 5/1988 | Hoen et al. | 292/111 |
| 4,758,031 | 7/1988 | Wolf . | |
| 4,813,253 | 3/1989 | Dumas . | |
| 4,850,209 | 7/1989 | Weinerman et al. . | |
| 4,958,865 | 9/1990 | Cheng | 292/111 |
| 5,060,492 | 10/1991 | Carpenter et al. . | |
| 5,511,834 | 4/1996 | Willems | 292/203 |

*Primary Examiner*—Brian K. Green
*Assistant Examiner*—Fredrick Conley
*Attorney, Agent, or Firm*—Freilich Hornbaker Rosen

[57] ABSTRACT

A latch is provided for holding a pair of case parts together, of a type that includes a frame (40) having a dish (42) that can mount in a hole of a first case part and a hasp (20) that can engage a strike (16) on the other case part. A slide (70) that can slide vertically on a bracket fixed to the dish, carries a bolt (30) that can be turned to move the slide up and down. The hasp has a first has end (22) pivotally mounted on the upper end of the slide and having a free second hasp end (24) for engaging the strike. The slide (70) is of sheet metal, with opposite slide sides (131, 132) that are bent around edges (60, 62) of a strip-shaped bracket (50) that extends vertically.

4 Claims, 2 Drawing Sheets

LATCH

BACKGROUND OF THE INVENTION

One type of latch that is used to hold upper and lower case parts together, includes a dish that mounts in a hole of the lower case part and a mechanism mounted on the dish, with the mechanism having a hasp with a catch at its upper end. The hasp is pivoted up so the catch lies immediately above a strike on the uppercase part, with the hasp then being slid down by several millimeters to lock to the catch. When the case parts are not locked together, it is often desirable to move the hasp to a stowed position wherein it extends generally downward so its catch is lowermost. U.S. Pat. No. 5,511,834 shows a latch assembly of this type.

When the hasp is in its stowed position, it is desirable that the hasp lie as close to the case as possible, that is, that the catch project a minimum outwardly of the face of the case. This minimizes the possibility of harm to a worker walking nearby or damage to packages moved against the latch or damage to the latch assembly itself. Such stowage of the hasp as close to the case as possible is especially important where the bottom of the dish lies a distance below the upper end of the case, so the hasp must be long.

In many prior latch assemblies, the hasp was "loosely" held, in that it could pivot by many degrees, such as at least five degrees, about a longitudinal axis so the catch could move from side to side. This could allow the case top to move if it did not otherwise interlock with the case bottom. Also, the sideward movement of several degrees by the hasp, resulted in a "cheap" feel of the latch. A latch which could stow the hasp in a compact position and which enabled the hasp to move vertically, but with no more than a few degrees of tilt, would be desirable.

SUMMARY OF THE INVENTION

In accordance with one embodiment of the present invention, a latch is provided which can be stowed so its hasp projects minimally, and which holds the vertically movable hasp so it resists sideward movement (or pivoting about a longitudinal axis) to provide a sturdy feel. The latch includes a frame with a dish and a bracket fixed to the dish, with the bracket forming a cam follower. A slide that is vertically slidable on the bracket, holds a bolt that has a cam engaged with the cam follower of the bracket, so when the bolt is turned the slide moves up or down. A hasp is pivotally mounted on the slide upper end, about a laterally-extending hasp axis, so the bolt and hasp vertically slide together. This results in a hole in the hasp receiving the bolt, for compact stowage, of all positions of the slide.

The bracket is in the form of a strip of sheet metal having parallel opposite side edges, and the slide is in the form of a piece of sheet metal having opposite sides that are each bent around a different one of the bracket strip side edges. The slide opposite sides that are bent around the bracket side edges, results in the slide not being tiltable by more than a few degrees, so the hasp is not tiltable by more than a few degrees.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
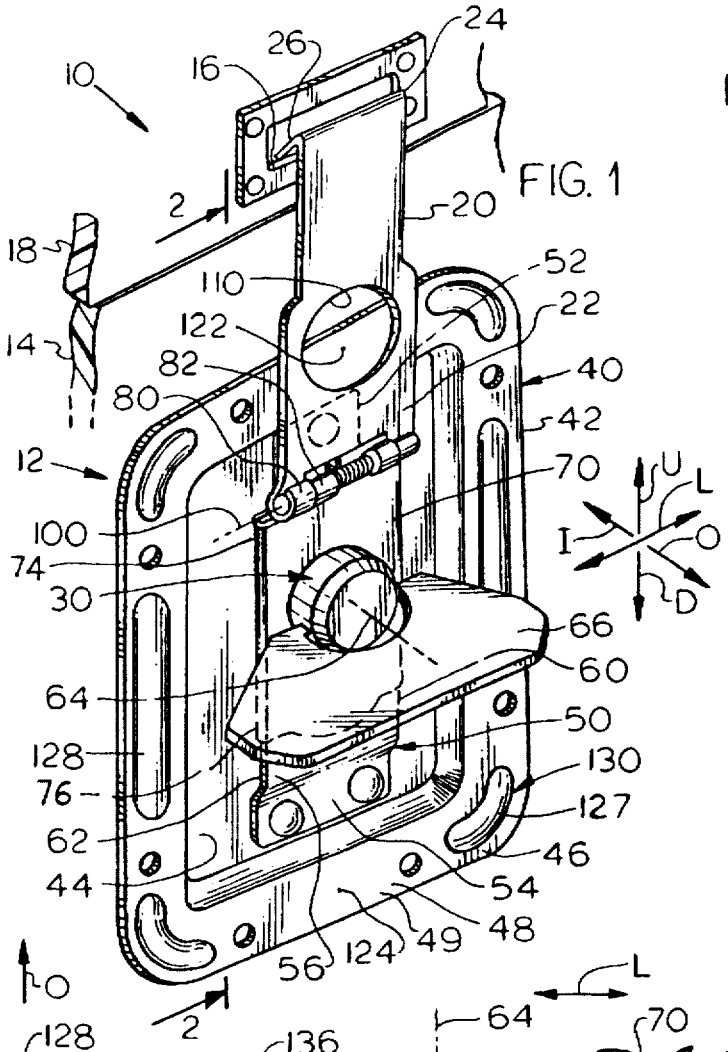
FIG. 1 is an isometric view of a portion of a case, with a latch of the present invention mounted on the lower case half, and with the slide lying in its uppermost position.

FIG. 1 illustrates a latch assembly 10 which includes a latch 12 mounted on a lower or first case part 14 and a strike 16 mounted on a second case part 18. The latch includes a hasp 20 with first and second ends 22, 24, the second or free end 24 having a catch 26 that can engage the strike 16. To hold the case parts together, the hasp 20 is pivoted to the position shown in FIG. 1, wherein its catch 26 lies above the strike 16. A bolt 30 is turned to move down the hasp by several millimeters, until the catch 26 presses firmly down against the strike 16. The case parts are then firmly locked to one another, until the bolt is turned in an opposite direction to raise the hasp 20 by several millimeters so the hasp can pivot out of line with the strike 16.

Figure 5:
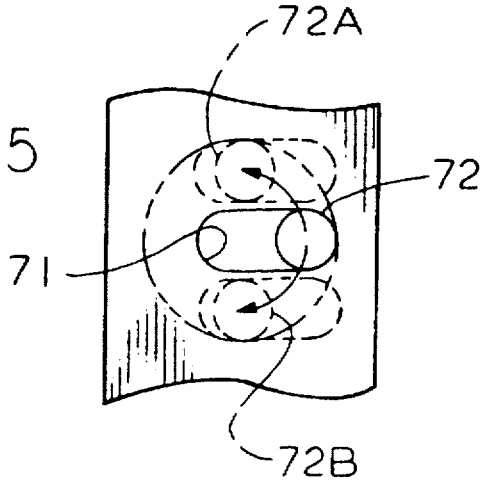
FIG. 5 is a simplified view of a cam arrangement that can be used in the latch of FIG. 1.

The latch includes a frame 40 comprising a sheet metal dish 42 with upper and lower ends 45, 47 having a dish bottom 44 and a flange-like dish perimeter 46 with a flange 48 having an outer face 49. A sheet metal bracket 50 of the frame lies in the dish and has top and bottom portions 52, 54 fixed to the bottom of the dish. The bracket has a middle portion 56 with parallel first and second side edges 60, 62 extending vertically. A sheet metal slide 70 with upper and lower ends 74, 76, is slidable mounted on the bracket middle portion, with the bracket closely confining the slide to vertical movement. The bolt 30 is mounted on the slide to move up and down with the slide. The bolt can turn about a bolt axis 64 extending in a longitudinal direction (parallel to arrows I and O), and has a handle 66 that enables manual turning of the bolt. As indicated in FIG. 5, the bracket middle portion 56 has a cutout that forms a cam follower 71, and the bolt has a cam 72 engaged with the cam follower. When the bolt is turned, its cam moves up to the position 72A or down to the position 72B, causing the slide to move up or down. It is noted that there are a variety of cam arrangements, such as that shown in U.S. Pat. No. 5,511,834, and any of these cam arrangements can be used.

Figure 2:
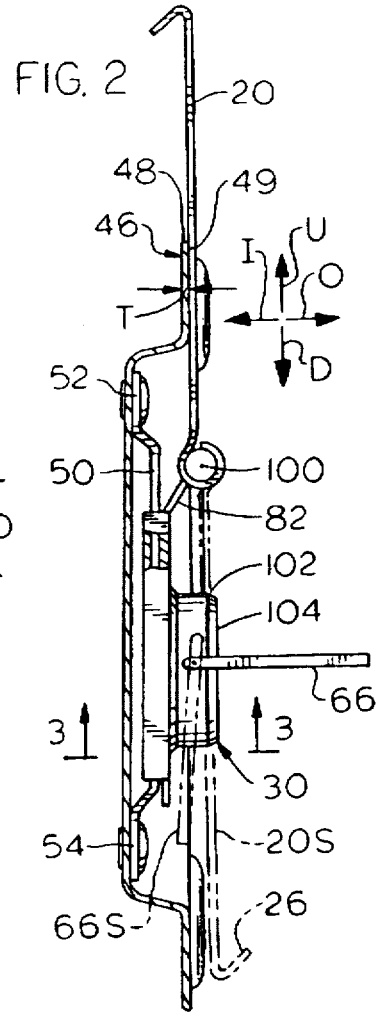
FIG. 2 is a sectional view taken on line 2—2 of FIG. 1.
Figure 4:
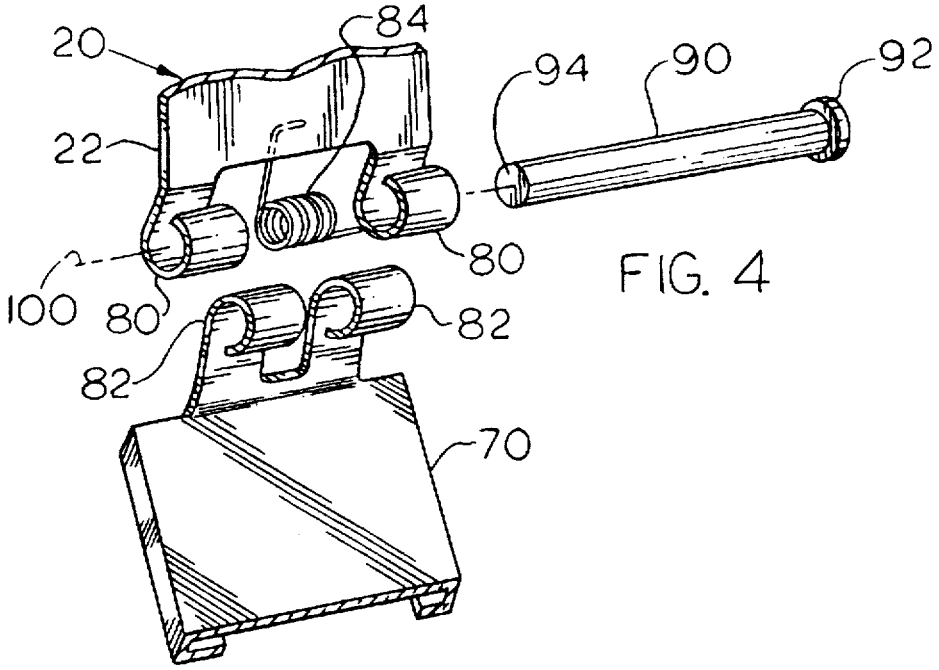
FIG. 4 is an exploded isometric view of a portion of the latch of FIG. 1.

As shown in FIG. 4, the first end 22 of the hasp has a pair of feet 80 bent into almost 360° loops. The upper end of the slide 70 has a pair of feet 82 that are bent into almost 360° loops. The legs 80, 82 are aligned, with a coil spring 84 positioned between the legs 82, and a pin 90 is inserted through the legs and the spring. The pin has one end 92 that is enlarged, and has an opposite end 94 that is deformed to enlarge it after the pin has passed through the legs, to hold the pin in place. The hasp can pivot about a hasp axis 100. As shown in FIG. 2, the spring urges the hasp to pivot to a stowed position wherein its free end at catch 26 lies below the hasp axis 1 00. The hasp axis preferably lies at least even with or outward of the flange outer face.

The bolt 30 has an outwardly (O) projecting bolt portion 102 whose outer end 104 lies outward of the flange 46. This is because the bolt is a die cast part for strength, and the handle 66 is pivotally mounted on the bolt so the handle can pivot to a stowed position 66S. As shown in FIG. 1, the hasp has a generally round hole 110 that is only slightly larger than the diameter of the bolt 30, so when the hasp is pivoted down to its stowed position, the bolt is received in the hole 110. As a result, the stowed hasp 20S (FIG. 2) does not project far outward beyond the flange 48 of the latch. The hole 110 results in minimum weakening of the flange because the hole is of about the same size as the bolt. The fact that the hasp and bolt slide vertically together, because both are mounted on the slide, results in the hole 110 always being aligned with the bolt in the stowed position.

As shown in FIG. 2, the legs 82 of the slide extend at an outward (O) and upward (U) incline. This locates the hasp axis 100 outward of the flange 46 of the dish. This construction enables the hasp 20 in its use position to lie substantially against the flange 46 at the top, and enables the hasp in its closed position to lie close to the dish flange 48. It is desirable that the hasp project minimally beyond the dish in its stowed position, to minimize the hasp injuring a person or damaging another nearby package that is pushed into it. As mentioned above, the hasp hole 110 avoids interference from the die cast bolt 30.

The dish perimeter 46 includes primarily the flat flange 48 especially at the middle top 122 and middle bottom 124, where the hasp lies in its use and and stowed positions. The perimeter also has six projecting parts 130 that help strengthen the dish perimeter and that also provide rounded bumps that keep objects away from the dish so they are less likely to engage other parts of the latch that could harm a person or another package. The projecting parts include four parts 127 at the four corners of the rectangular flange, and two vertically elongated projecting parts 128 at the laterally opposite sides of the flange. The projecting parts project by more than twice the thickness T of the sheet metal.

Figure 3:
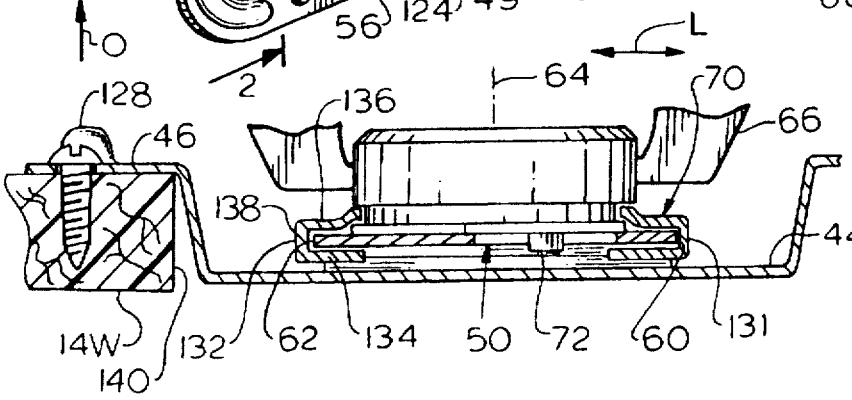
FIG. 3 is a sectional view taken on line 3—3 of FIG. 2.

FIG. 3 shows the bracket 50 and its opposite side edges 60, 62, and shows the slide 70 and its opposite slide sides 131, 132. Each of the slide sides 131, 132 is bent in a loop, to form inner and outer sides 134, 136 and a slide edge 138. These parts 134, 136, 138 closely surround the corresponding bracket side edge 60, 62. The slide extends along more than 50% of the length (in directions U, D) of the straight bracket middle portion 56. As a result, the slide is prevented from tilting more than a few degrees about the bolt axis 64 or about an axis extending in the lateral direction L. The result is a sturdy latch and one that has a high quality feel, because of the minimum amount of "looseness". The bottom 44 of the dish lies in a hole 140 of the first case wall 14W, with the flange 46 mounted facewise against the case wall.

While terms such as "up", "down" etc. have been used to help describe the invention as illustrated, it should be understood that the latch can be used in any orientation with respect to the Earth.

Thus, the invention provides a latch for mounting on a case part, wherein the latch has a hasp that can be pivoted up to a use position and down to a stowed position. A first end of the hasp is pivotally mounted on the upper end of a slide that can slide up and down by several millimeters, with a bolt for moving the slide, being rotatably mounted on the slide to move up and down with it. The slide includes a piece of sheet metal with opposite sides that extend closely around opposite side edges of a bracket that extends vertically and that has upper and lower ends fixed to the bottom of the dish of the latch. The hasp has a hole that closely receives the bolt.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A latch for mounting on a first case part (14) to secure it to a strike (16) on a second case part (18), comprising:

a frame (40) for mounting on said first case part, said frame including a dish (42) and a bracket (50) fixed to said dish, said bracket forming a cam follower (71); a slide (70) that is vertically slidable on said bracket and that has upper and lower ends (74, 76);

a bolt (30) rotatably mounted on said slide, said bolt having a cam (72) engaged with said cam follower of said bracket and having a handle (66) that can be turned to turn said bolt and cam to vertically slide said bolt and said slide along said bracket;

a hasp (20) having a first end (22) pivotally mounted on said slide upper end (74) to enable said hasp to pivot about a hasp axis (100), said hasp having a second end (24) forming a catch (26) for engaging said strike;

said bracket being formed of sheet metal with a strip-shaped middle portion (56) having parallel opposite vertical side edges (60, 62) and said bracket having upper and lower ends (52, 54) each fixed to said dish, and said slide having opposite sides (131, 132) each extending around one of said vertical side edges to closely position said slide in vertical movement along said bracket.

2. The latch described in claim 1 wherein:

said dish bottom has upper and lower ends (45, 47) and said bracket upper and lower ends are mounted respectively on said dish bottom upper and lower ends.

3. The latch described in claim 1 wherein:

said dish includes a piece of sheet metal having a perimeter with a flange (48) lying in a plane for mounting facewise against the first case part, said sheet metal of said forming having a plurality of projections (130) projecting outwardly of said flange by more than twice the thickness of said piece of sheet metal.

4. The latch described in claim 1 including:

a coil spring (84) coupled to said hasp first end and to said slide, and urging said hasp to pivot to a stowed position (20S) wherein said hasp second end lies under said hasp first end; and wherein said catch at said sheet metal hasp second end is bent so it projects outwardly in said stowed position;

said bolt has an outer end (102) that projects at least as far from said dish bottom as said dish flange, and said hasp has a bolt-receiving hole (110) positioned to receive the outer end of said bolt.

* * * * *